US009556630B2

(12) United States Patent
Rosati

(10) Patent No.: US 9,556,630 B2
(45) Date of Patent: Jan. 31, 2017

(54) PANEL SUPPORT BRACKET

(71) Applicant: FORM 700 PTY LTD, Altona, VIC (AU)

(72) Inventor: Emilio Rosati, Altona (AU)

(73) Assignee: Form 700 Pty Ltd, Victoria (AU)

( * ) Notice: Subject to any disclaimer, the term of this patent is extended or adjusted under 35 U.S.C. 154(b) by 0 days.

(21) Appl. No.: 14/426,720

(22) PCT Filed: Sep. 6, 2013

(86) PCT No.: PCT/AU2013/001002

§ 371 (c)(1),
(2) Date: Mar. 6, 2015

(87) PCT Pub. No.: WO2014/036601

PCT Pub. Date: Mar. 13, 2014

(65) Prior Publication Data

US 2015/0211242 A1 Jul. 30, 2015

(30) Foreign Application Priority Data

Sep. 7, 2012 (AU) ..... 2012903915

(51) Int. Cl.

| | |
|---|---|
| ***E04G 17/16*** | (2006.01) |
| ***E04B 5/32*** | (2006.01) |
| ***E04G 21/26*** | (2006.01) |
| ***E04G 11/48*** | (2006.01) |
| ***E04B 1/16*** | (2006.01) |
| ***E04G 21/32*** | (2006.01) |
| ***E04C 2/04*** | (2006.01) |
| ***E04F 21/18*** | (2006.01) |

(Continued)

(52) U.S. Cl.

CPC ..... *E04G 21/26* (2013.01); *E04B 1/164* (2013.01); *E04C 2/044* (2013.01); *E04F 21/18* (2013.01); *E04G 11/48* (2013.01); *E04G 21/3247* (2013.01); *E04B 2/94* (2013.01); *E04B 2005/322* (2013.01); *E04B 2103/02* (2013.01); *E04G 11/365* (2013.01); *E04G 17/16* (2013.01)

(58) Field of Classification Search

CPC ..... E04B 1/35; E04B 2005/322; E04G 17/16; E04G 11/365; E04G 11/48; E04G 21/26

See application file for complete search history.

(56) References Cited

U.S. PATENT DOCUMENTS

| | | | | |
|---|---|---|---|---|
| 3,035,321 A | | 5/1962 | Hennig | |
| 4,478,385 A | * | 10/1984 | Maier | E04G 11/28 249/20 |
| 7,513,480 B2 | * | 4/2009 | Bergaretxe | E04G 11/28 249/20 |

FOREIGN PATENT DOCUMENTS

| | | |
|---|---|---|
| FR | 2606059 | 5/1988 |
| GB | 620311 | 3/1949 |
| GB | 741730 A | 12/1955 |

* cited by examiner

*Primary Examiner* — Michael Safavi
(74) *Attorney, Agent, or Firm* — Klauber & Jackson LLC

(57) ABSTRACT

This invention relates to a positioning apparatus for an upright panel of a building, the apparatus comprising a base adapted to depend from a structure associated with the building or construction thereof, a support for an edge of the panel, and a positional adjustment means depending from the base which provides for positional adjustment of the support relative to the base. A system for positioning a precast panel which incorporates the apparatus, along with methods for using the apparatus and method are also disclosed.

17 Claims, 6 Drawing Sheets

(51) Int. Cl.

| | |
|---|---|
| *E04B 2/94* | (2006.01) |
| *E04G 11/36* | (2006.01) |

PANEL SUPPORT BRACKET

CROSS REFERENCE TO RELATED APPLICATIONS

The present application is a National Stage Application claiming the priority of co-pending PCT Application No. PCT/AU2013/001002, filed Sep. 6, 2013, which in turn, claims priority from Australian application No. 2012903915, filed Sep. 7, 2012. Applicant claims the benefits of 35 U.S.C. §120 as to the PCT application and priority under 35 U.S.C. §119 as to the said Australian application, and the entire disclosures of both applications are incorporated herein by reference in their entireties.

INCORPORATION BY REFERENCE

The following publications are referred to in the present application and their contents are hereby incorporated by reference in their entirety:

International Patent Application No PCT/AU2003/001112 titled "A LIFTING OR TRANSPORTING MEANS USING A RECIPROCATING JACK".

The following co-pending patent application is referred to in the following description:

PCT/AU2013/000689 titled "IMPROVED FRAME FOR CLIMBING SCREEN" and filed on 26 Jun. 2013 claiming priority from Australian Provisional Patent Application No 2012902703.

The content of each of these applications is hereby incorporated by reference in their entirety.

TECHNICAL FIELD

This invention relates to a positioning apparatus for an upright panel during the construction of a multi-storey building, and a system employing the same.

BACKGROUND

Prior to the pouring of an elevated slab, it is known to use props extending through openings in formwork to support upright panels (including, but not limited to precast panels) which may be used as formwork for edges of cast-in-place concrete and/or which require the structural support of being cast with the slab. However, fine positioning of such a panel is required before the slab can be poured, so a crane is used to assist with the positioning process. However, such positioning is an iterative, and therefore time consuming process, so it ties up the crane for considerable periods of time.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

In one aspect, although this need not be the only or indeed the broadest form of this, the invention may be said to reside in a positioning apparatus for an upright panel of a building, the apparatus comprising a base adapted to depend from a structure associated with the building or construction thereof, a support for an edge of the upright panel, and a positional adjustment means depending from the base which provides for positional adjustment of the support relative to the base.

In one form, the base is so adapted to depend (ie from the structure) by way of being cooperatively shaped and configured for mounting to the structure. This adaptation may comprise, but need not be limited to, one or more of a complimentary base shape, and male and/or female engaging base features.

In one form, the structure from which the base depends may be any one of, but need not be limited to, a building structure, formwork supporting structure or a safety screen assembly or the like. Accordingly, the base may be an interchangeable component of the positioning apparatus, so that an appropriate base can be selected according to the structure from which the positioning apparatus is to depend.

In one form, the base comprises means for securement thereof to the structure. In one form, this securement means is releasable. This securement means may comprise, but need not be limited to, one or more of fasteners, locking pins, clips and the like.

In one form, the positional adjustment means provides for adjustment in at least two axes (or two dimensionally). In one form, the two axes of adjustment are lateral and vertical.

In one form, the positional adjustment means comprises lateral adjustment means for lateral positional adjustment of the support relative to the base.

In one form, the positional adjustment means comprises vertical adjustment means for vertical positional adjustment of the support relative to the base.

In one form, the lateral adjustment means comprises a rail depending from the base, and a carriage for the support which is disposed to run along the rail.

In one form, the apparatus comprises means for driving movement of the carriage. In one form this drive means may comprise, but need not be limited to, one or more of a lead screw (be this manually driven or powered), a rack and pinion gear set or a linear actuator.

In one form, the vertical adjustment means comprises a length adjustable strut extending between the carriage and the support. In an alternative, the length adjustable strut comprises a linear actuator, such as a hydraulic or pneumatic ram, to drive adjustment of its length.

In one form, in an alternative, the vertical adjustment means comprises a length adjustable linear actuator. When employed in this way, the linear actuator will depend from the carriage and carry the support.

In one form, the vertical adjustment means comprises means for setting the length of the strut once adjusted. This setting means may comprise, but need not be limited to, one or more of fasteners, locking pins, clips and the like.

In one form, the support is adapted to support the upright panel by way of being cooperatively shaped and configured for this purpose. This adaptation may comprise, but need not be limited to, one or more of a complimentary (ie to the panel) support shape, and male and/or female panel engaging features.

In one form, the support may be an interchangeable component of the positioning apparatus, so that an appropriate support can be selected appropriate for the size and type of upright.

In one form, the support comprises means for securing the panel thereto. In one form, this securement means is releasable. This securement means may comprise, but need not be limited to, one or more of clamping means, straps, fasteners, pins, clips and the like.

In a further aspect, the invention may be said to reside in a method for positioning an upright panel using the above described apparatus, the method comprising the steps of mounting the apparatus to or with respect to the structure, and adjusting and then setting the positional adjustment means to position the support and the upright panel.

In a further aspect, the invention may be said to reside in a system for positioning an upright panel, wherein the system comprises at least a pair of the above described apparatus arranged in a vertically spaced fashion so that a support of a lowermost apparatus supports a lowermost edge of the panel, and a support of an uppermost apparatus supports an uppermost edge of the panel.

In one form, the system further comprises at least first and second pairs of apparatus, where the first pair support uppermost and lower edges of the panel at or toward a first end thereof, and the second pair support uppermost and lower edges of the panel at or toward a distal end thereof.

In yet a further aspect, the invention may be said to reside in a method for positioning an upright panel using the above described system, the method comprising the steps of mounting each apparatus to or with respect to the structure, and adjusting and then setting each positional adjustment means to position each support and the upright panel.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

For a better understanding of this disclosure it will now be described with respect to an exemplary embodiment which shall be described herein with the assistance of drawings wherein.

In the following description, like reference characters designate like or corresponding parts throughout the several views of the drawings.

DESCRIPTION OF EMBODIMENTS

Figure 1:
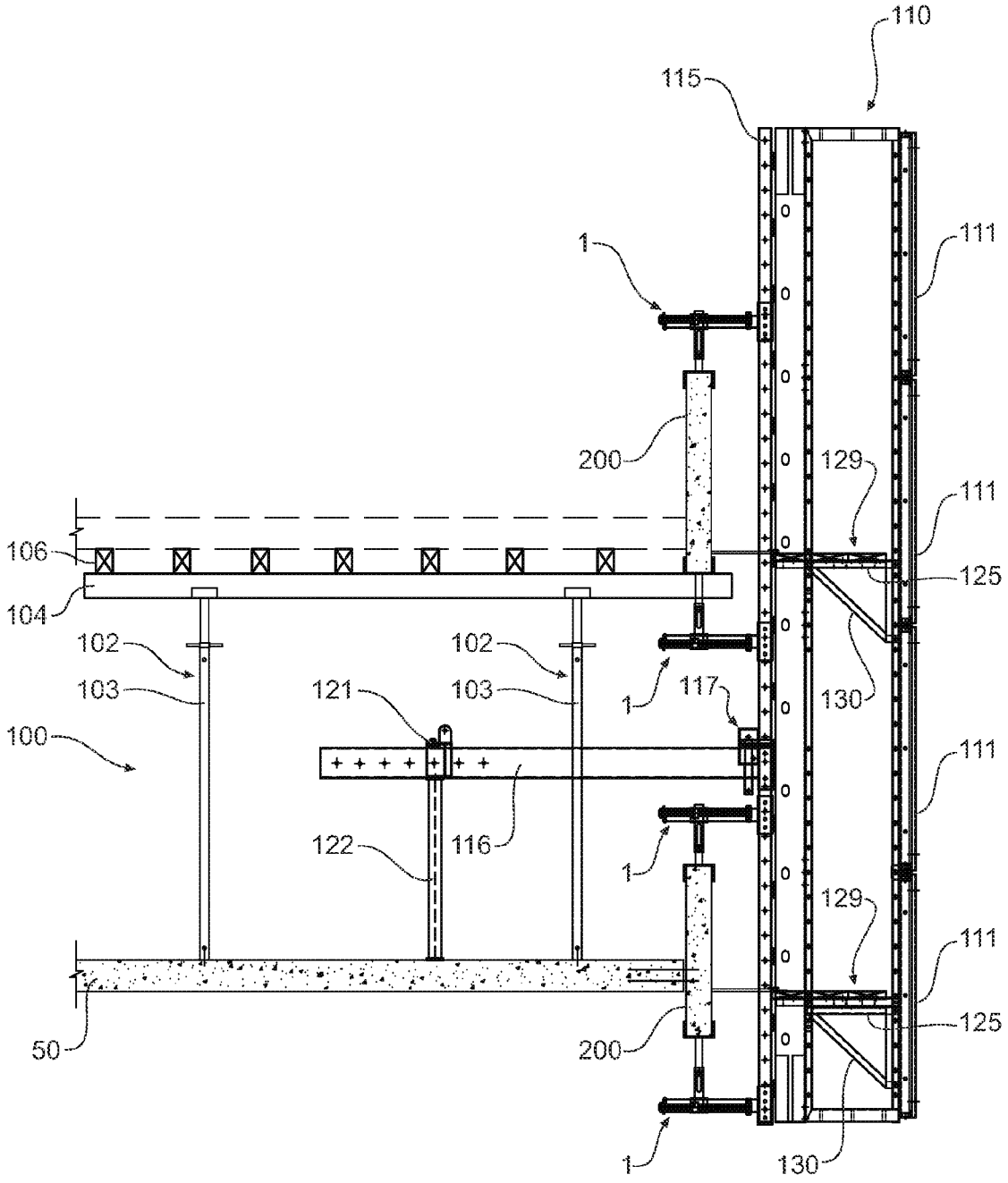
FIG. 1 is a schematic side view of formwork, a safety screen assembly and positioning apparatus according to the present invention in use during construction of a multi-storey building.
Figure 2:
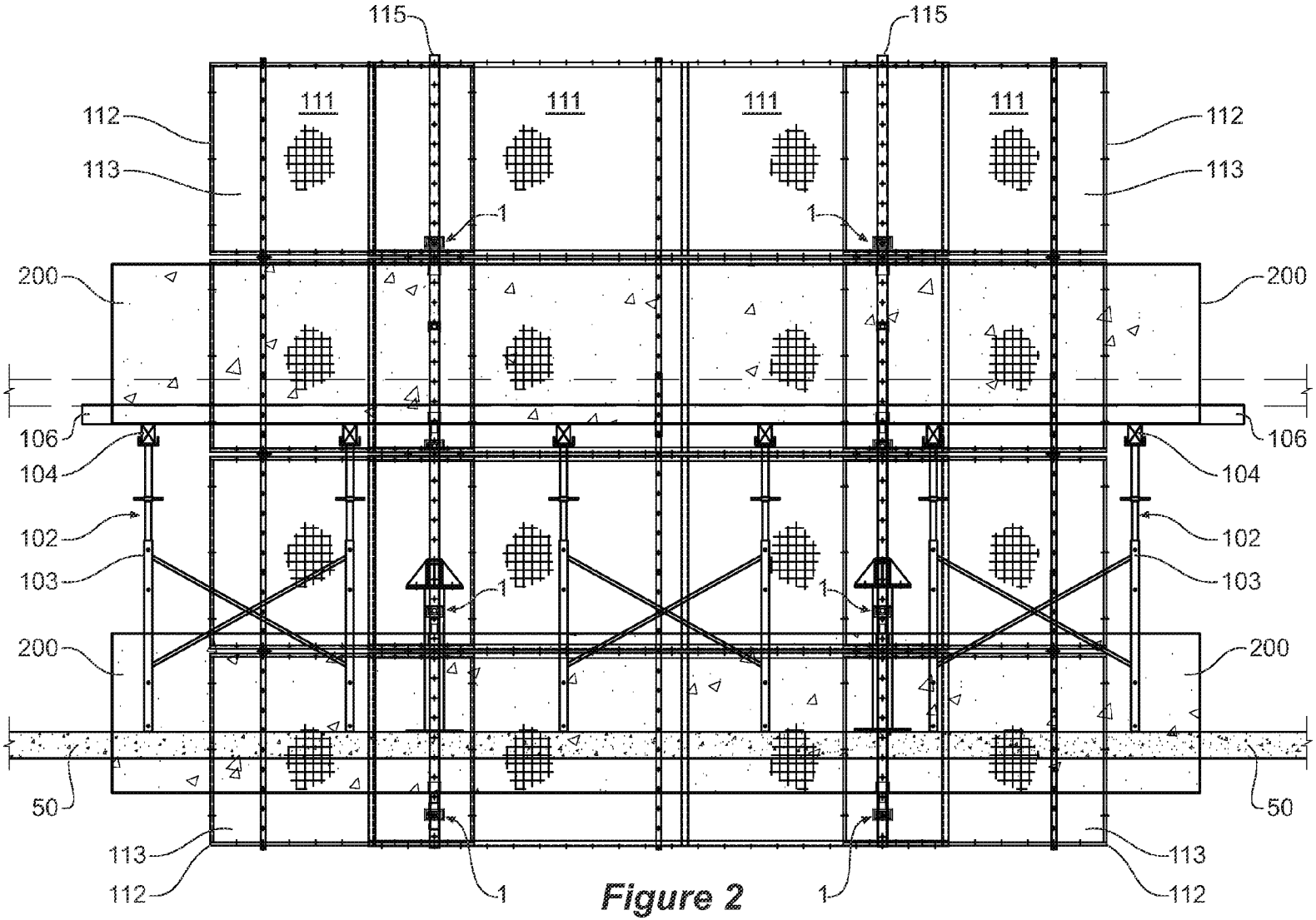
FIG. 2 is a front view of the schematic in FIG. 1.

Referring now to FIGS. 1 through 4, where there is illustrated a slab 50 of a floor (or storey) of a building under construction supporting a hardware assembly 100 for forming an elevated concrete slab (represented with dashed lines) which will become the next storey of the building.

The hardware assembly 100 comprises support frames 102 comprising props 103 supporting an array of timber bearers 104, which in turn support an array of timber joists 106 sitting atop of and extending normal to the bearers 104, which in turn support formwork panels or sheets (not illustrated).

Depending from edges of the uppermost formed floors is a safety screen assembly 110 of the kind described in PCT/AU2013/000689. The safety screen assembly 110 screens the external surface of the building whilst this is awaiting final fixing of windows or external walls. This prevents people and objects from falling from the building while formwork is being fixed on the upper most floor 50 to create the next floor (shown in dashed lines).

This safety screen assembly 110 comprises a plurality of screen panels 111, where each screen panel 111 comprises a frame 112 with an infill of mesh 113. The screen panels 111 are supported by a pair of vertical frame elements 115. The vertical frame elements 115 are in turn supported by two horizontal support beams 116 (also referred to as 'needles'). The vertical frame elements 115 are supported by a respective horizontal support beam 116 via a bracket 117 which is also referred to as a 'shoe'. The bracket 117 enables the vertical frame elements 115 to move vertically with respect to each horizontal support beam 116 in the manner as described in the earlier patent specification PCT/AU03/01112. The means of raising the safety screen panels 111 in the case of the present invention is the same as that described in that earlier patent application.

The horizontal support beams 116 are, in the illustrated embodiment, attached with respect to the slab 50 of a building floor. A saddle 121 is located over each horizontal support beam 116 and is secured to the slab 50 via a pedestal 122. This arrangement holds the vertical frame elements 15 rigidly with respect to the slab 50.

As can be seen in FIG. 1, the screen panels 111 are supported so that they are spaced away from the vertical frame elements 115.

A walkway 129 is provided that extends between the screen panels 111 and the edge of the slab 50. The walkway 129 comprises a first section of wooden planks that are supported by beams 125 and additional brackets 130.

Figure 3:
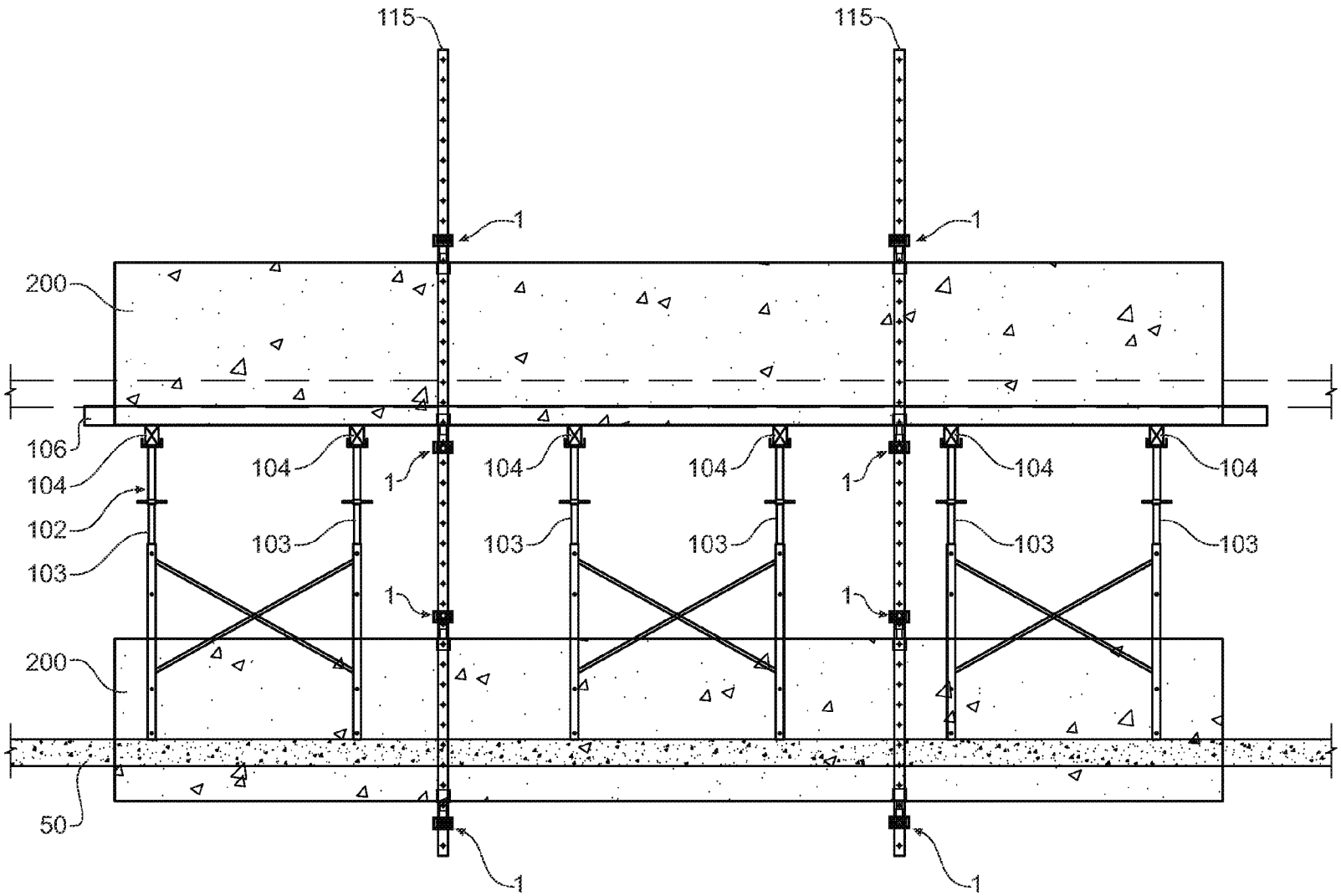
FIG. 3 is the front view of FIG. 2 with the safety screen assembly removed to improve visibility of the other items.
Figure 4:
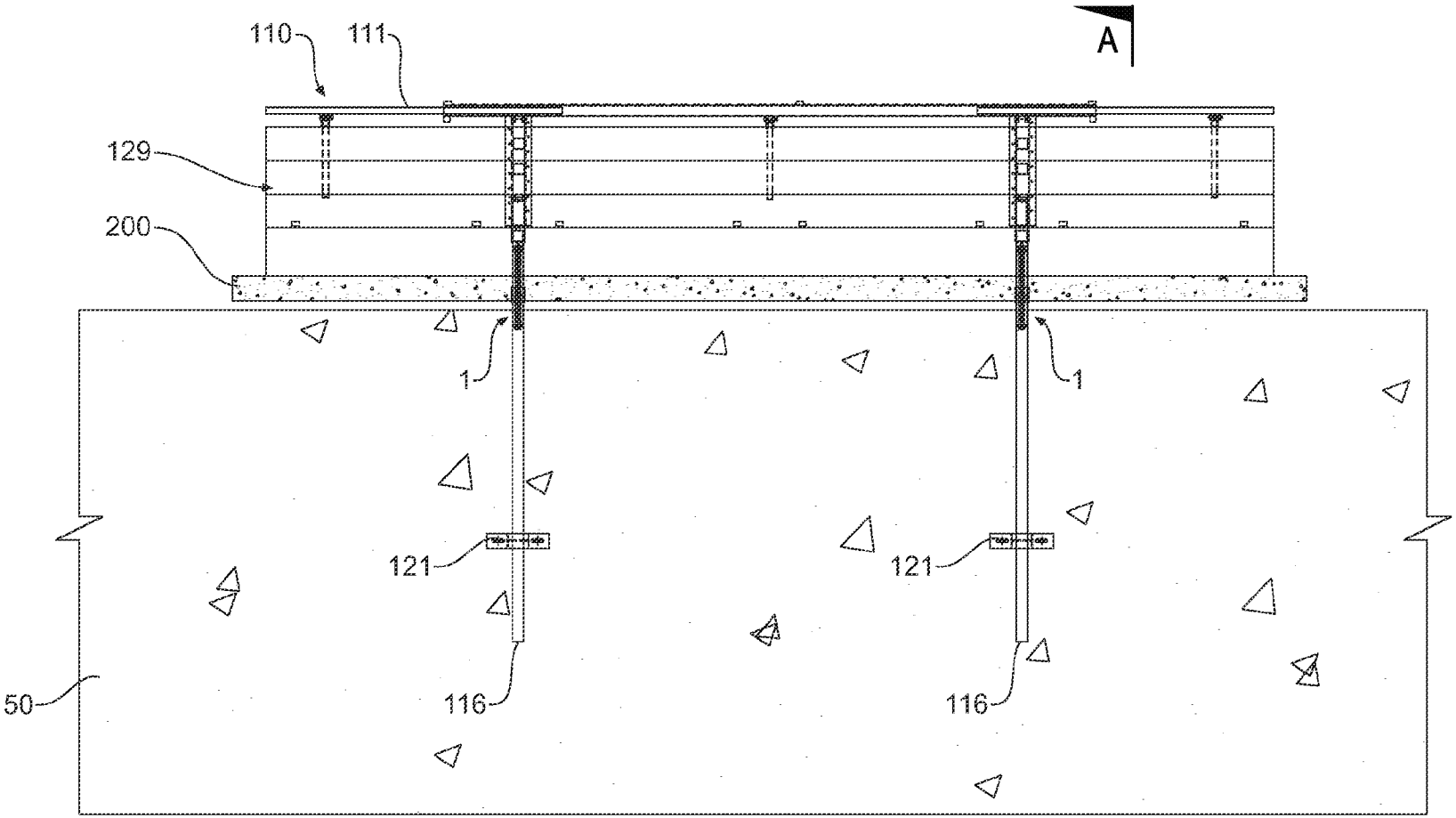
FIG. 4 is a plan view of the schematic of FIG. 1.

As seen in FIG. 3, the safety screen assembly 110 depends from a completed slab 50 and extends vertically to provide screening for the subsequent slabs that are to be formed.

The walkway 129 will provide access to the edge of the slab 50 and newly formed slabs to enable the various post forming operations such as post-stressing to occur.

In cases where an upright panel 200 is to be supported for casting with a slab to be poured (such as shown dashed), the present invention provides for a positioning apparatus 1 and system which will assist with fine positioning of the panel 200 without need for substantial crane time.

The upright panel 200 may be any one or more of a precast cladding or curtain wall, a load-bearing wall, a shear wall, a spandrel, balustrade or a wall panel (with or without a window), and connected by any one of bolted, welded or dowel/anchor bolt connections.

Referring now to FIGS. 5 through 10, each positioning apparatus 1 comprises a base 10 adapted to depend from a supporting structure, being namely, in the illustrated embodiment at least, a vertical member of the safety screen assembly 110. Alternatively however, the base 10 could be adapted to depend from a part of the hardware assembly 100 (such as a prop 102), or a part of a structure of the building, such a structural column or a completed floor 50.

Each positioning apparatus 1 further comprises a support 20 for an edge of the panel 200, and a positional adjustment means 30 depending from the base 10 which provides for positional adjustment of the support 20 relative to the base 10.

Figure 5:
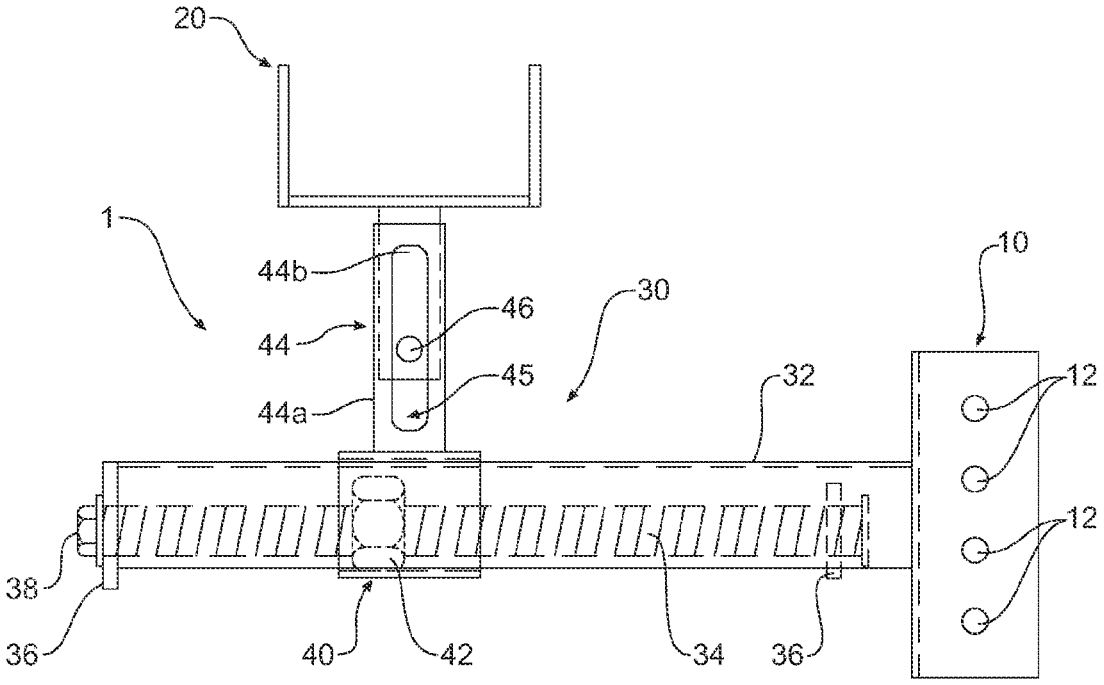
FIG. 5 is a side view of a positioning apparatus according to the present invention.
Figure 6:
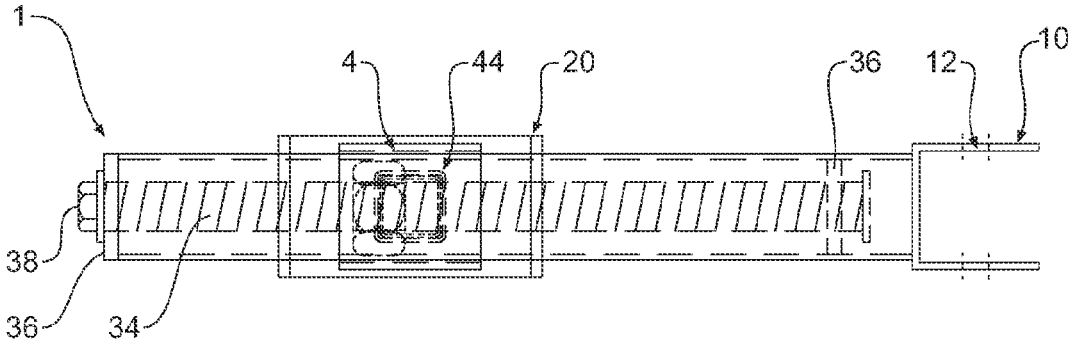
FIG. 6 is a plan view of the positioning apparatus of FIG. 5.
Figure 7:
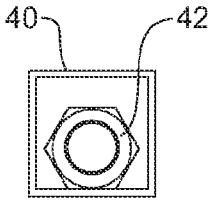
FIG. 7 is an end view of the carriage from the positioning apparatus of FIG. 5.
Figure 8A:
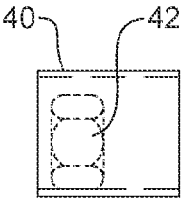
FIG. 8A is a side view of the carriage from the positioning apparatus of FIG. 5.
Figure 8B:
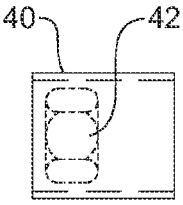
FIG. 8B is a plan view of the carriage from the positioning apparatus of FIG. 5.
Figure 10:
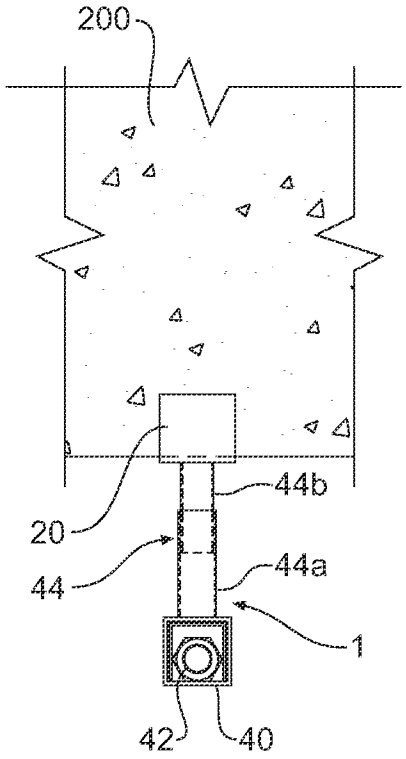
FIG. 10 is an end view of the apparatus of FIG. 9 supporting an upright precast panel.
Figure 9:
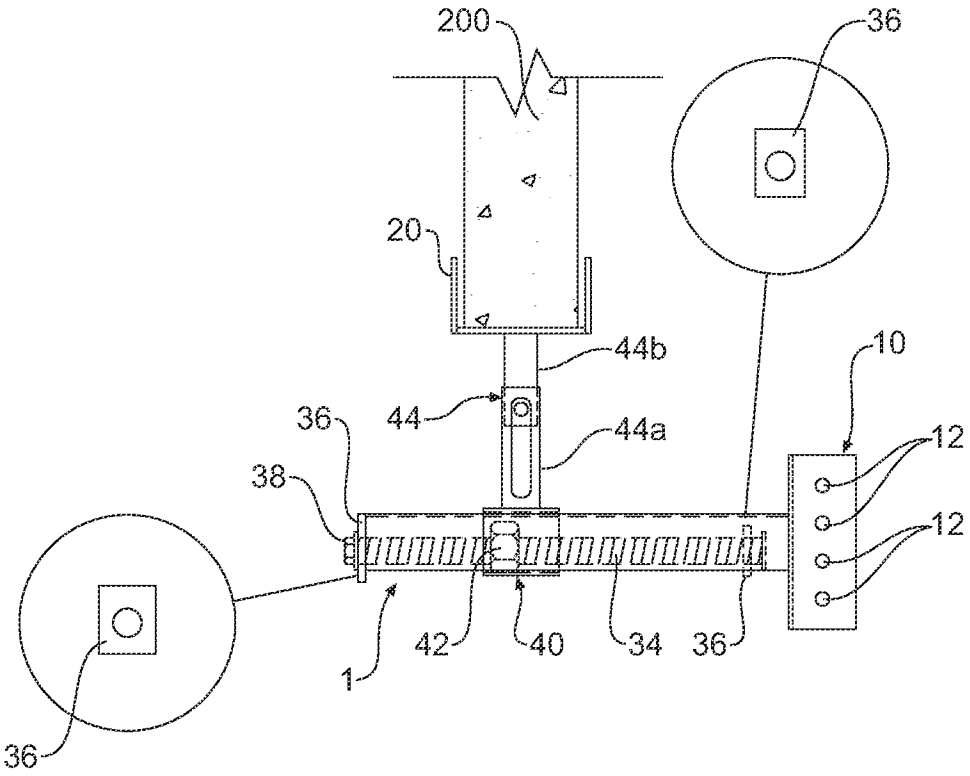
FIG. 9 is a side view of a positioning apparatus' supporting an upright precast panel.

With reference to FIGS. 5 and 6, it can be seen that in the illustrated embodiment at least, the base 10 is a length of RHS steel with one wall removed (by cutting) so as to create a U-shaped channel shaped to nest over the vertical member 115 of the safety screen assembly 110. A series of holes 12 are drilled through opposing side walls of the U-shaped channel at positions spaced lengthwise along the base 10; the base 10 can be secured to the supporting structure via bolts extending through both these holes 12, and aligned holes in the supporting structure.

Depending from the base 10 in a cantilever fashion is a rail 32 formed from a length of RHS steel. Similar to the base 10, one wall of the RHS steel is removed so as to create a U-shaped channel. Inside of the rail 32 is a threaded rod (or lead screw) 34 rotatably supported between a pair of end plates 36 so as to extend along the rail 32 and through a free end thereof, at which point a drive nut 38 is welded to the rod 34, via which drive nut 38 the rod 34 can be driven to rotate.

A carriage 40 for the support 20 is disposed to run along the rail 32. The carriage 40 comprises a short length of RHS steel sized so as to form a sleeve which passes over the rail 32 with a sliding fit. Welded to the inside of the carriage 40 is a large nut 42 which is threaded onto the lead screw 34, so that when drive nut 38 is turned by an operator using a spanner, the carriage 40 will be driven along the lead screw 34.

Extending from the carriage 40 is a telescopically extensible strut 44, the length of which can be adjusted and set as required. The extensible strut 44 comprises a strut sleeve 44*a* which is slotted lengthwise in a pair of opposing walls thereof, and which depends from the carriage 40, and a rod 44*b* of RHS steel which is sized to slide in the strut sleeve 44*a*. The length of the extensible strut 44 can be set by tightening a bolt 46 which runs in the slots 45 and passes through a hole in the rod 44*b*.

Fixed to the end of the rod is the support 20, being namely, in the illustrated embodiment at least, a U-shaped bracket (or cradle) which is sized to nest an edge of the upright panel 200 which is to be positioned by the apparatus 1.

In use, first and second pairs of vertically spaced apparatus 1 are set in position. Each apparatus 1 is bolted to the support structure via bolts passed through aligned holes in each of the base 10 (ie via the holes 12) and the supporting structure. More particularly, in the illustrated embodiment each apparatus is bolted to the vertical frame members 115 of the safety screen assembly 110.

A surveyor will mark the joists 106 with the correct position for a given panel 200. Using a crane, the upright panel 200 is then lowered into its approximate position resting edgewise on the timber joists 106. That is to say, the full weight of the panel 200 is not to be carried by the plurality of apparatus 1, but the hardware assembly 100.

For each apparatus 1 the length of the telescopically extensible strut 44 is adjusted to bring the support cradle 20 into a supporting position with respect to the edge of the panel 200. In this way, the first pair of apparatus 1 support uppermost and lower edges of the panel 200 at or toward a first end thereof, and the second pair of apparatus 1 support uppermost and lower edges of the panel 200 at or toward a distal end thereof.

Once the panel 200 is prevented from falling sideways by the four (or more) apparatus 1, the crane can release the panel 200. The fine positioning of the panel 200 is then carried out by making fine adjustments of each of the apparatus 1 as required. For each apparatus 1, fine adjustments to the position of panel 200 can be effected by adjusting the position of the carriage 20 along the rail 32 by turning the drive nut 38 until the panel 200 is both plumb and correctly positioned on the joists 106.

In this way, one or more apparatus 1 can be adjusted and the panel 200 slightly shifted. The position of the panel 200 can be checked by a surveyor, and the panel 200 shifted again by adjustment of one or more apparatus 1 as required. This process can be repeated until the panel 200 is correctly positioned. The slab can then be poured, with panel 200 acting as a part of the formwork for the pouring. Once the concrete is cured, the hardware assembly 100 and positioning apparatus 1 can be removed.

Advantageously then, the apparatus 1 and system according to the present invention facilitates the fine positional adjustment of an upright panel without a crane, and with a high degree of accuracy.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A positioning apparatus for an upright panel of a building, the apparatus comprising:

a base adapted to indirectly attach to the building via a structure associated with the building or construction thereof, a support for an edge of the panel, and a positional adjustment means depending from the base which provides for positional adjustment of the support relative to the base, wherein the positional adjustment means comprises:

a lateral adjustment means for lateral positional adjustment of the support relative to the base, the lateral adjustment means comprising a rail extending from the base in a cantilever fashion, and a carriage for the support disposed to run along the rail; and a vertical adjustment means for vertical positional adjustment of the support relative to the base, the vertical adjustment means comprising a length adjustable strut that extends between the carriage and the support;

wherein fine adjustments to the position of the panel can be effected by adjusting the lateral adjustment means, and wherein the positioning apparatus further comprises means for driving movement of the carriage.

2. The positioning apparatus of claim 1, wherein the length adjustable strut comprises means for setting the length of the strut once adjusted.

3. The positioning apparatus of claim 1, wherein the base comprises means for securement thereof to the structure.

4. The positioning apparatus of claim 3, wherein the securement means of the base is releasable.

5. The positioning apparatus of claim 1, wherein the support comprises means for securing the panel thereto.

6. A method for positioning an upright panel using the apparatus of claim 1, the method comprising the steps of mounting the apparatus to or with respect to the structure, and adjusting and then setting the positional adjustment means to position the support and the upright panel.

7. A system for positioning an upright panel, the system comprising at least a pair of the positioning apparatus according to claim 1, arranged in a vertically spaced fashion so that a support of a lowermost apparatus supports a lowermost edge of the panel, and a support of an uppermost apparatus supports an uppermost edge of the panel.

8. The system of claim 7, wherein the system further comprises at least first and second pairs of apparatus, where the first pair support uppermost and lower edges of the panel at or toward a first end thereof, and the second pair support uppermost and lower edges of the panel at or toward a distal end thereof.

9. A method for positioning an upright panel using the system of claim 7, wherein the method comprises the steps of mounting each apparatus to or with respect to the structure, and adjusting and then setting each positional adjustment means to position each support and the upright panel.

10. The positioning apparatus of claim 1, wherein the base comprises a U-shaped channel adapted to nest over a vertical member of the structure.

11. The positioning apparatus of claim 1, wherein the driving means comprises a threaded rod extending along the rail and a drive nut at an end thereof via which drive nut the threaded rod can be driven to rotate, wherein a nut attached to the carriage is threaded onto the threaded rod, and wherein in use, when the drive nut is turned, the carriage is driven along the threaded rod.

12. The positioning apparatus of claim 1, wherein the driving means comprises a rack and pinion gear set.

13. The positioning apparatus of claim 1, wherein the driving means comprises a linear actuator.

14. The positioning apparatus of claim 1, wherein the length adjustable strut is telescopically extendible.

15. A system for positioning an upright panel of a building, the system comprising at least a pair of positioning apparatus, each position apparatus comprising a base adapted to depend from a structure associated with the building or construction thereof, a support for an edge of the panel, and a positional adjustment means depending from the base which provides for positional adjustment of the support relative to the base, wherein the positioning apparatus are arranged in a vertically spaced fashion so that a support of a lowermost apparatus supports a lowermost edge of the panel, and a support of an uppermost apparatus supports an uppermost edge of the panel.

16. The system of claim 15, wherein the system further comprises at least first and second pairs of apparatus, where the first pair support uppermost and lower edges of the panel at or toward a first end thereof, and the second pair support uppermost and lower edges of the panel at or toward a distal end thereof.

17. A method for positioning an upright panel using the system of claim 15, wherein the method comprises the steps of mounting each apparatus to or with respect to the structure, and adjusting and then setting each positional adjustment means to position each support and the upright panel.

* * * * *